United States Patent [19]

Okamoto

[11] 4,127,696

[45] Nov. 28, 1978

[54] MULTI-CORE COMPOSITE FILAMENTS AND PROCESS FOR PRODUCING SAME

[75] Inventor: Miyoshi Okamoto, Takatsuki, Japan

[73] Assignee: Toray Industries, Inc., Tokyo, Japan

[21] Appl. No.: 831,047

[22] Filed: Sep. 6, 1977

Related U.S. Application Data

[63] Continuation-in-part of Ser. No. 745,161, Nov. 26, 1976, abandoned.

[30] Foreign Application Priority Data

Jun. 17, 1976 [JP] Japan ..... 51-70379

[51] Int. Cl.[2] ..... D01D 7/04; D02G 3/04

[52] U.S. Cl. ..... 428/373; 57/244; 156/296; 264/177 R; 428/374; 428/397; 57/248; 57/905

[58] Field of Search ..... 57/140 R, 140 C, 153, 57/149, 162, 164; 428/364, 373–375, 378, 392, 395–397, 400, 401; 264/140, 171, 177 R; 156/166, 198, 296, 175, 179, 180

[56] References Cited

U.S. PATENT DOCUMENTS

| | | | |
|---|---|---|---|
| 3,084,070 | 4/1963 | Teot | 57/153 X |
| 3,249,669 | 5/1966 | Jamieson | 57/140 J X |
| 3,315,454 | 4/1967 | Carranza | 57/140 R |
| 3,447,308 | 6/1969 | Fontijn et al. | 57/153 X |
| 3,531,368 | 9/1970 | Okamoto | 57/140 BY X |
| 3,546,063 | 5/1968 | Breen | 428/364 |
| 3,645,819 | 2/1972 | Fujii | 156/296 |
| 4,008,344 | 2/1977 | Okamoto et al. | 428/373 X |

*Primary Examiner*—Donald Watkins

*Attorney, Agent, or Firm*—Cushman, Darby & Cushman

[57] ABSTRACT

Disclosed are an improved islands-in-a-sea type multi-core composite filament comprising at least two different polymer components and having a cross-section wherein each island is surrounded by some other islands and most of the islands have an approximately quadrilateral to hexagonal cross-section, and also a process for producing the above-said composite filament.

10 Claims, 3 Drawing Figures

MULTI-CORE COMPOSITE FILAMENTS AND PROCESS FOR PRODUCING SAME

This application is a continuation-in-part of application Ser. No. 745,161, filed on Nov. 26, 1976, now abandoned.

SUMMARY OF THE INVENTION

The invention relates to improved multi-core composite filaments.

Various types of islands-in-a-sea type multi-core composite filaments have been heretofore known. For example, there are the filaments of the types disclosed in U.S. Pat. Nos. 3,562,374, 3,531,368, 3,707,341, 3,641,232 and 3,188,689. These known composite filaments are different from the multi-core composite filaments of the present invention, as hereinbelow described, in the points that in the known filaments the sea component ratio is too high, the cross-sections of the islands studded in the sea component are round and the islands are arranged on only one circle in the filament cross-section.

The object of the present invention is to provide a multi-core composite filament of new type, more particularly to provide an islands-in-a-sea type multi-core composite filament of a novel configuration wherein the cross-sections of the islands are of a polygonal shape as is seen in natural deer skin or wool.

Bundles of extra fine fibers having polygonal cross-sections as in natural collagen fibers could not have hitherto been obtained, because there were no definite means for obtaining such fiber bundles. It has hitherto been believed that in order to obtain lobular fibers it is necessary to employ nozzles having a modified non-circular cross-section during the spinning. Attempts have been made to obtain lobular fibers by applying a composite spinning technique. However, the desired fiber bundles have not yet been obtained successfully owing to technical difficulties, particularly the difficulty of forming inner islands having polygonal cross-sections.

It is another object of the present invention to provide an islands-in-a-sea type composite filament which is hard to get lean when the sea component is removed to obtain a bundle of extra fine filaments, so that a fabric constituted from the filament bundle can have excellent massive appearance and resilience.

It is still another object of the present invention to achieve economy in resource and energy consumption by reducing the loss of the sea component.

The above-mentioned objects can be attained by the following construction of the present invention.

The present invention provides an islands-in-a-sea type multi-core composite filament comprising at least two different polymer components and having a cross-section wherein each island is surrounded by some other islands, characterized in that the sea component is contained in an amount less than 35% based on the weight of all components and most of the islands have an approximately quadrilateral to hexagonal cross-section.

Preferably, the sea component is contained in an amount of less than 10% by weight. It is also preferable that the cross-sections of the islands positioned at the most outside portion of the filament are of approximately quadrilateral or pentagonal shape and the cross-sections of the inner islands surrounded by the outside islands are of approximately quadrilateral to nonagonal shape.

The multi-core composite filaments according to the present invention have the following characteristics or effects.

1. Since the islands of the filament have polygonal cross-sections and the filament has a configuration wherein each island is surrounded by other islands, as is seen in the configuration of the cell or fibril of wool or the configuration of deer skin, the suede-like products obtained from the multi-core composite filaments of the present invention have a feel similar to natural deer skin.

2. The processability in spinning and drawing is similar to that of the island component polymer.

3. The amount of the sea component to be removed is small and, thus, the amount of the solubilizer to be used for the removal of the sea component can also be small. As a result, environmental pollution is reduced and economy in energy consumption can be realized.

4. Since the filaments which compose, for example, a knitted, woven or non-woven fabric, being hard to get lean when the sea component is removed, a dimensionally stable and dense sheet-like material can be obtained.

5. The surface luster and distortion property of the fine filaments obtained after the removal of the sea component, and the falling-off property of the fine fibers from an entangled body composed of the stapled fine filaments obtained after removing the sea component, are unique and very different from the case of the analogus filaments having circular cross-sections.

6. The multi-core composite filament can be effectively heat set during texturing, even before the removal of the sea component, because of the high content of the island component and, thus, can have high crimpability. Therefore, a fabric obtained using the textured composite filaments can easily generate high crepe.

7. The sea component can easily be removed only by mechanically beating, buffing or raising the composite filament and shaking off the peeled sea component. Thus, in the case where the fine filament bundle, which is obtainable by removing the sea component, is to be used, it is possible to subject the composite filament per se to usual processes without passing through a step for removing the sea component.

8. Even if a polymer of low melting point, for example, polystyrene or a copolymer of styrene and another vinyl monomer, is employed as the sea component, the staining of the heating plate for drawing is little observed and, thus, troubles which may be caused by such staining can be avoided.

9. The feeding of the sea component can be carried out by a very small apparatus as compared with the apparatus for feeding the island component.

10. The multi-core composite filament can easily be divided into fine filaments composed of the island component, and paper and felt can easily be made using the composite filament.

DETAILED DESCRIPTION OF THE INVENTION

Figure 1:
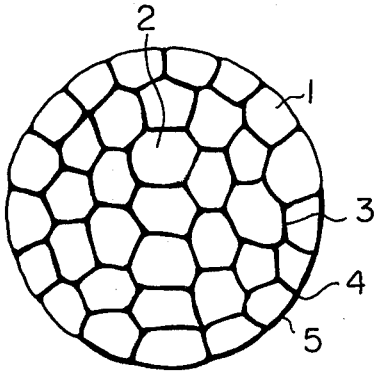

The invention is explained in detail below.

The multi-core composite filament of the present invention may contain the sea component in an amount of less than 35%, preferably less than 10%, particularly less than 5%, by weight. In the case where the sea component content is not less than 35% by weight, the cross-sections of the islands of the resulting filament become too round so that the objects of the present invention can not be attained. In the present invention, since the islands are interacted, so as to be deformed, due to the limited intervals between the islands owing to the highness of the island component content, the islands easily have approximately quadrilateral or pentagonal cross-sections at the most outside portion of the resulting filament and approximately quadrilateral to nonagonal cross-sections at the inner portion. In order to obtain such a composite filament, the inner holes of the spinneret to be used should preferably be arranged so as to easily obtain the desired cross-sections of the islands.

In the composite filament of the present invention, if the sea component is in an amount of less than 5% by weight, the sea component can easily be peeled off by mechanical action without using a solvent.

As the sea and island component polymers, any fiber-forming polymers may be employed. Preferred polymers are those which have been known as polymers for multi-core composite filaments, for example, polyesters, polyamides, polyacrylonitriles, polyurethanes, polyolefins and polystyrene. It is particularly preferable that polyethylene terephthalate is used as the island component and polystyrene or a copolymer of styrene and another vinyl monomer is used as the sea component.

The thickness and distribution of each island in the composite filament of the present invention are not critical. For example, the islands may have various thicknesses different from one another.

The multi-core composite filament of the present invention may have a circular cross-section or may have a cross-section of trilobal, tetralobal, T or hollow shape. In any case, the islands positioned at the most outside portion of the composite filament always have approximately quadrilateral or pentagonal cross-sections due to the interfacial tension yielded during the spinning. On the other hand, the inner islands may have approximately quadrilateral to nonagonal cross-sections due to the very low content of the sea component.

The number of the islands is preferably 7 to 1,000, and more preferably 10 to 200.

The multi-core composite filament of the present invention may be produced by forming a composite stream consisting of at least two different polymers, wherein a multiplicity of island component streams composed of one or more of the polymers are distributed in a sea component stream of the other polymer, so that said island component streams are arranged on two or more concentric circles, with a content of said island component of no less than 65%, preferably no less than 90%, based on the total weight of the polymers, and ejecting the composite stream from a spinning orifice.

In the process, preferably only the sea component is ejected at the initial stage of the spinning. After confirming the stable discharge of the sea component from the spinning orifice, ejection of the island component is started. Then, the ejected weight ratio of the island component to the sea component is gradually increased to finally attain the desired content of the island component.

Preferably, there may be employed for the practice of the process a spinneret as shown in FIG. 9 of U.S. Pat. No. 3,692,423 or British Pat. No. 1,302,584. The spinneret may be modified by removing the first plate (29) or providing several projections at the inlet portion of the third plate (31) to disturb the flow of the sea component stream.

Further, in the case where the thickness of the sea component layer positioned at the surface portion of the resulting composite filament is to be increased, any one of the spinnerets as shown in FIGS. 12 to 16 of U.S. Pat. No. 3,692,423 may effectively be employed. Also, the means as disclosed in Japanese Patent Publication No. 44-23208 may be employed for the practice of the process according to the present invention.

One of the underlying principles of the process of the present invention is summarized in claim 6 of U.S. Pat. No. 3,531,368.

In order to spin the filament stably for a long time, it is suitable to employ a spinneret having a spinning orifice of large diameter. For example, in the case where the spinning orifice has a circular cross-section, the diameter of the spinning orifice is preferably no less than 0.5 mm, more preferably no less than 1.0 mm, and even more preferably no less than 1.2 mm. Further, it is important to employ sea and island component polymers having close values of viscosity. For example, where the combination of a styrene polymer and polyethylene terephthalate is employed, the ratio of the intrinsic viscosity of polyethylene terephthalate to the intrinsic viscosity of the stylene polymer is preferably in a range between 0.63 and 1.10. Preferable ratios of the intrinsic viscosity of polyethylene terephthalate to the intrinsic viscosity of the styrene polymer are, for example, 0.66:0.64, 0.71:0.87, 0.80:0.95, 0.60:0.99 and 0.71:0.64, in which the intrinsic viscosity of polyethylene terephthalate is a value measured in ortho-chlorophenol at 25° C. and that of the styrene polymer is a value measured in toluene at 30° C. Polystyrene having no less than 0.87 is particularly preferably employed. It should, however, be noted that the above-mentioned ratios may be varied depending upon the spinning conditions employed such as the spinning temperature and cooling condition.

In the attached drawings, examples of the multi-core composite filament obtained by the above-mentioned process are shown.

FIG. 1 is a schematic cross-sectional view of a multi-core composite filament containing 3.8% by weight of sea component and 96.2% by weight of island component, and having 36 islands.

Figure 2:
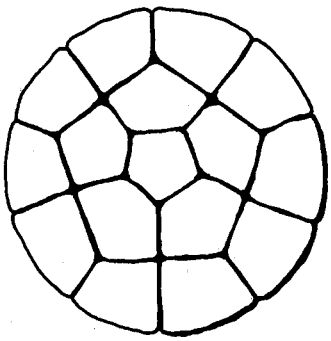

FIG. 2 is a schematic cross-sectional view of another multi-core composite filament containing 3.0% by weight of sea component and 97.0% by weight of island component and having 16 islands.

Figure 3:
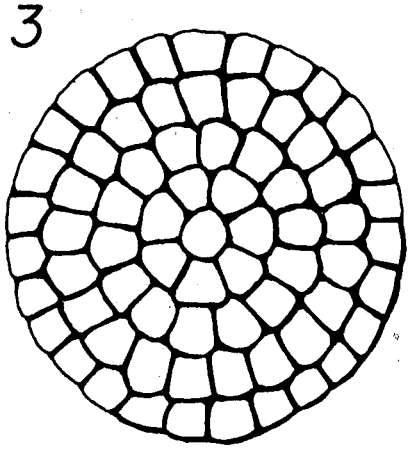

FIG. 3 is a schematic cross-sectional view of a further multi-core composite filament containing 3.0% by weight of sea component and 97.0% by weight of island component and having 70 islands.

In FIG. 1, 1 denotes an island positioned at the most outside portion of the filament. The most outside islands have approximately quadrilateral or pentagonal cross-sections. 2 denotes an inner island, and each of the inner islands has an approximately quadrilateral to nonagonal cross-section. 3 is the sea component positioned at the boundaries between the islands. The sea component shown by 4 makes the corners of the polygonal islands slightly round. 5 is the sea component positioned at the surface portion of the filament. In this example, this portion is a very thin layer and the thickness of this layer is of an order which can only be observed by a scanning type electron microscope, and can not be observed by a usual light microscope.

The multi-core composite filament of the present invention can advantageously be used for simulated synthetic leather, knitted fabrics, woven fabrics, felt, filters, paper, and materials for furniture, wall decoration, sporting goods, medical supplies and the like.

The invention will now be further illustrated by the following non-limitative examples.

EXAMPLE 1

Multi-core composite filaments were spun under the following conditions.

Island component
polyethylene terephthalate having an intrinsic viscosity of 0.70, measured in ortho-chlorophenol at 25° C.

Sea component
polystyrene having an intrinsic viscosity of 0.869, measured in toluene at 30° C.

Number of islands
36 per filament.

Ratio of island component to sea component
96.2:3.8 (by weight)

Spinning temperature
285° C.

Take-up rate
1,300 m/min.

The spun filaments were taken up into yarns while being heated by a heating tube provided immediately below the used spinneret. The undrawn yarns were then bundled and drawn with steam, crimped in a stuffing box and cut into staples in a usual manner. The draw ratio was 3.1. The obtained staples had a cross-section of regularly arranged islands, as shown in FIG. 1, wherein the islands on the most outside circle were of approximately quadrilateral or pentagonal cross-section and the inner islands were of approximately pentagonal or hexagonal cross-section. Each staple had 14 crimps per 25 mm and a length of 51 mm. At the bends of the crimps, the islands were partially divided due to the cracking of the sea component, so that the staples were very soft to the touch.

The staples were formed into a web of a weight of 470 g/m$^2$, using a carding machine and a cross-wrapper, and the web was then needle punched to form a felt of an apparent density of 0.198 g/cm$^3$. The felt was impregnated with a 12% aqueous solution of polyvinyl alcohol and dried. Then, the felt was immersed into trichloroethylene and immediately thereafter squeezed on a mangle. The immersing and squeezing were repeated 4 times and then the felt was dried. The measurement of the reduced weight of the obtained felt proved that polystyrene was substantially completely removed from the staples of the felt. During the above-mentioned treatment, the reduction of the felt thickness was very small and, thus, it was confirmed that the sea component could be very efficiently removed without any trouble.

The felt was then impregnated with polyurethane and the polyurethane was coagulated. Then, the obtained sheet was subjected to buffing. Observation of the obtained sheet by an electron microscope showed that the configuration of the sheet was just like that of natural deer skin. The sheet was excellent in sofeness, massive appearance and resilience, and the raised fibers of the surface thereof were hard to entangle and had a dull but deep luster.

EXAMPLE 2

An undrawn yarn obtained as described in Example 1 was drawn at 150° C. and at a draw ratio of 3.6, obtain a 75 denier/24 filament yarn. Using this filament yarn as weft and an ordinary polyethylene terephthalate filament yarn as warp, a 4-harness satin weave was made.

The fabric was immersed in trichloroethylene, dried and, thereafter, subjected to raising. The polystyrene was substantially completely removed during the trichloroethylene immersion of only 3 minutes. During the above-mentioned treatment, no substantial yarn slippage or slackening was observed. The raising was carried out by passing the fabric through a raising machine 17 times. The fabric had excellent raised fibers which are hard to entangle, was fairly good in resilience and had a graceful touch, no yarn slippage and a deep luster.

EXAMPLE 3

The procedure as described in Example 1 was repeated, except that the multi-core composite filaments were spun with the number of islands being 16 or 70 per filament, instead of 36 per filament. Excellent sheets similar to that of Example 1 were obtained.

What is claimed is:

1. An islands-in-a-sea type multi-core composite filament comprising at least two different polymer components and having a cross-section wherein each island is surrounded by some other islands, characterized in that the sea component is contained in an amount less than 10% based on the total weight of the polymer components, and most of the islands have an approximately quadrilateral to hexagonal cross-section, the cross-sections of the islands positioned at the most outside portion of said filament being of approximately quadrilateral or pentagonal shape and the cross-sections of the inner islands surrounded by said outside islands being of approximately quadrilateral to nonagonal shape.

2. A composite filament according to claim 1, wherein the island component polymer is polyethylene terephthalate and the sea component polymer is polystyrene or a copolymer of styrene and another vinyl monomer.

3. A composite filament according to claim 2, wherein the ratio of the intrinsic viscosity of polyethylene terephthalate to the intrinsic viscosity of polystyrene the copolymer of styrene is in a range between 0.63 and 1.10.

4. A composite filament according to claim 1, wherein said sea component content is less than 5% by weight.

5. A composite filament according to claim 1, wherein the number of the islands is 7 to 1,000.

6. A composite filament according to claim 1, wherein the number of the islands is 10 to 200.

7. A process for producing an islands-in-a-sea type multi-core composite filament comprising forming a composite stream consisting of at least two different polymers, wherein a multiplicity of island component streams composed of one or more of the polymers are distributed in a sea component stream of the other polymer, so that said island component streams are arranged on two or more concentric circles, with a content of said island component of no less than 90% based on the total weight of the polymers, and ejecting said composite stream from a spinning orifice.

8. A process according to claim 7, wherein said island component polymer is polyethylene terephthalate, said sea component polymer is polystyrene or a copolymer of styrene and another vinyl monomer and the ratio of the intrinsic viscosity of polyethylene terephthalate to the intrinsic viscosity of the styrene polymer is in a range between 0.63 and 1.10.

9. A process according to claim 7, wherein said composite stream is ejected from a spinning orifice of a diameter of no less than 1.0 mm.

10. A process according to claim 7, wherein said island component streams are formed by discharging the island component polymer from nozzles of a circular cross-section.

* * * * *